US005881348A

United States Patent [19]

Onodera et al.

[11] Patent Number: 5,881,348

[45] Date of Patent: Mar. 9, 1999

[54] RELEASE AGENT SUPPLYING MEMBER, RELEASE AGENT SUPPLYING APPARATUS AND FIXING APPARATUS USING THE SAME

[75] Inventors: Ken Onodera; Shuho Yokokawa; Kunitomo Takahashi; Hiroshi Ueno; Sho Sawahata; Tetsuya Ohba, all of Ibarakai, Japan

[73] Assignee: Hitachi Koki Co., Ltd., Tokyo, Japan

[21] Appl. No.: 955,116

[22] Filed: Oct. 21, 1997

[30] Foreign Application Priority Data

Oct. 25, 1996 [JP] Japan ..... 8-283738

[51] Int. Cl.[6] ..... G03G 15/20

[52] U.S. Cl. ..... 399/325; 118/DIG. 1

[58] Field of Search ..... 399/324, 325; 219/216; 432/59, 60; 222/630; 118/DIG. 1

[56] References Cited

U.S. PATENT DOCUMENTS 5,045,889 9/1991 Hoover ..... 399/325

5,320,159 6/1994 Schneder et al. ..... 164/268

FOREIGN PATENT DOCUMENTS 8-137317 5/1996 Japan .

*Primary Examiner*—Joan Pendergrass

*Attorney, Agent, or Firm*—Sughrue, Mion, Zinn, Macpeak & Seas, PLLC

[57] ABSTRACT

A release agent supplying member (21) is formed by release agent discharge portions (21*a*) for discharging release agent, and liquid level uniforming portions (21*b*) for uniforming a liquid level of the release agent discharged from the release agent discharge portions before supplying the release agent discharged from the release agent discharge portions to a subject to be coated.

20 Claims, 5 Drawing Sheets

RELEASE AGENT SUPPLYING MEMBER, RELEASE AGENT SUPPLYING APPARATUS AND FIXING APPARATUS USING THE SAME

BACKGROUND OF THE INVENTION

1. Field of the Invention

The present invention mainly relates to a release agent supplying member, a release agent supplying apparatus each for supplying release agent to a subject to be coated and a fixing apparatus using it.

2. Description of the Related Art

In a fixing apparatus which heats and pressurizes a toner image formed on recording material by means of a heat roller and a pressure roller thereby to fix the toner image on the recording material, release agent is, generally, coated on the surface of the heat roller so as to improve the releasing characteristics between the heat roller and the toner image.

Conventionally, there have been proposed various types of release agent supplying apparatuses used in such a kind of fixing apparatus. As one mode of such a release agent supplying apparatus, there is known a release agent supplying apparatus which includes, as shown in FIG. 6, a release agent tank 17 for receiving release agent therein, a pump 18 for drawing the release agent within the release agent tank 17, a release agent supplying member 19 having release agent discharge portions 19*a* for discharging the release agent drawn from the release agent tank 17, and a release agent coating roller 14 for receiving the release agent 20 flowing down on the upper surface of the release agent supplying member 19.

In such a configuration, the release agent 20 is supplied from the tank 17 through the pump 18. The release agent 20 drawn by the pump 18 is discharged from the release agent discharge portions 19*a* which are provided at the release agent supplying member 19 and formed by a large number of through holes. The release agent 20 thus discharged is wiped with the release agent coating roller 14 through the rotation thereof, then the release agent 20 thus transferred to the surface of the release agent coating roller 14 is coated on the surface of the heat roller 11*a*.

In the aforesaid configuration of the conventional release agent supply apparatus, at the time of supplying the release agent 20 to the heat roller 11*a*, the release agent 20 discharged from each of the release agent discharge portions 19*a* flows down on the upper surface of the release agent supplying member in a stripe fashion as shown in FIG. 7. Accordingly, an amount of the release agent coated on the heat roller 11*a* becomes uneven along the axial direction thereof due to such phenomenon that the liquid level of the release agent 20 on the upper surface of the release agent supplying member 19 becomes uneven in accordance with the arrangement of the release agent discharge portions 19*a* as shown in FIG. 8. Another phenomenon which creates an uneven distribution of releasing agent along the heat roller 11*a* is that several flows of the release agent are joined to form a single flow on the upper surface of the release agent supplying member since the flows of the release agent fluctuate.

When the fixing process is carried out when an uneven amount of the release agent is coated on the heat roller, gloss of a toner image after the fixing process may become uneven where an excessive amount of release agent is coated on the heat roller. Further, there appears a so-called offset phenomenon wherein the toner image adheres to the heat roller 11*a* at the portion where an insufficient amount of the release agent is coated such that suitable releasing characteristics are not obtained at such a portion on the surface of the heat roller 11*a*. Accordingly, there arises a problem that the printing quality is degraded.

SUMMARY OF THE INVENTION

The present invention has been made to solve the above problem, and therefore an object of the present invention is to provide a release agent supplying member and a release agent supplying apparatus which can supply release agent to a subject to be coated uniformly.

Another object of the present invention is to provide a fixing apparatus which supplies release agent to a subject to be coated uniformly and provides stable printing quality.

In order to achieve the aforesaid objects, a release agent supplying member is formed by release agent discharge portions for discharging release agent, and liquid level uniforming portions for uniforming a liquid level of the release agent discharged from the release agent discharge portions. The liquid level uniforming portions make the liquid level of the release agent uniform before supplying the release agent to a subject to be coated.

The above and other objects and features of the present invention will be more apparent from the following description taken in conjunction with the accompanying drawings.

DETAILED DESCRIPTION OF THE PREFERRED EMBODIMENTS

An embodiment of the present invention will be described with reference to the accompanying drawings.

Figure 5:
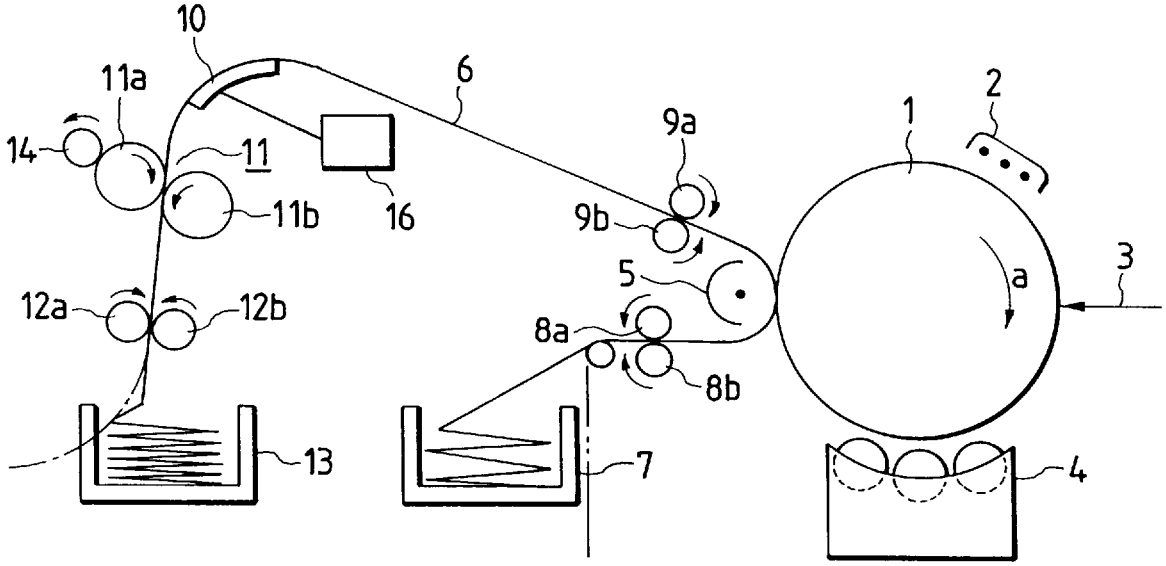
FIG. 5 is an entire configuration of an electrophotographic apparatus.
Figure 6:
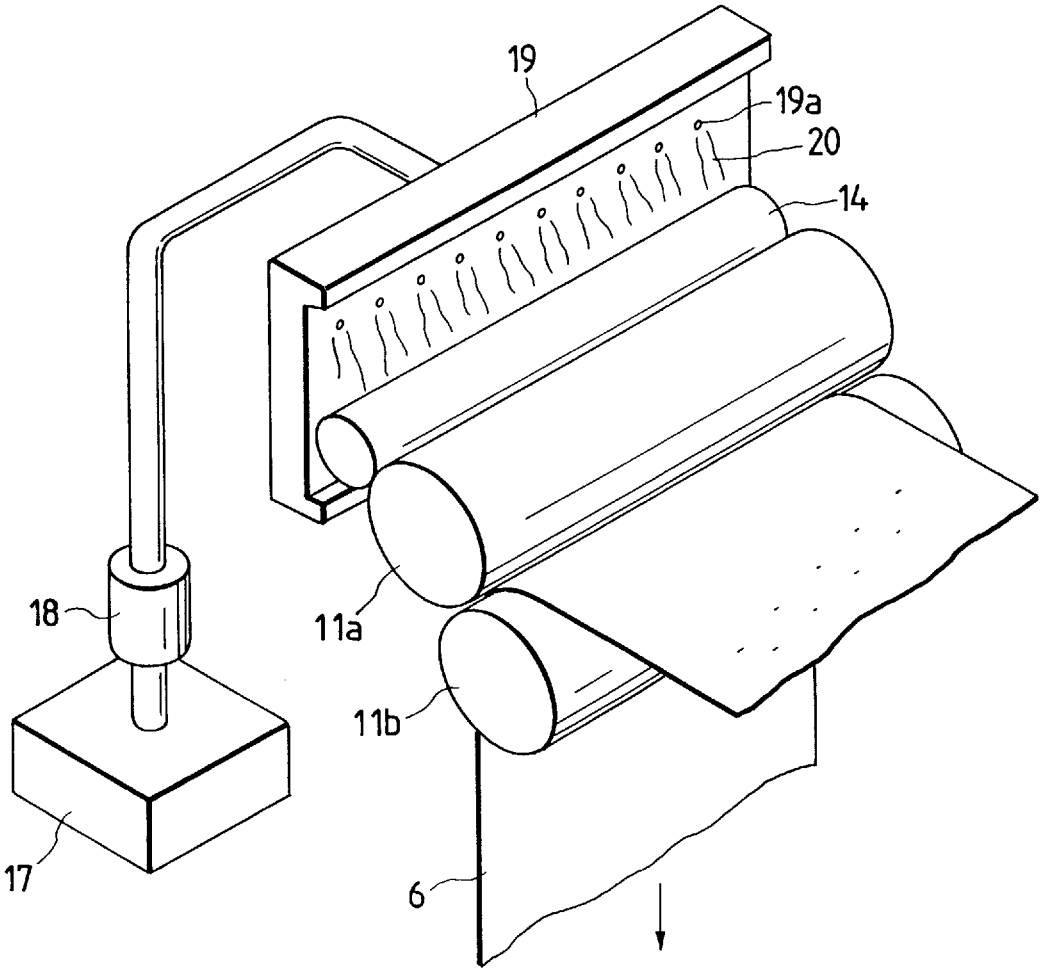
FIG. 6 is a perspective view showing a conventional fixing apparatus.
Figure 7:
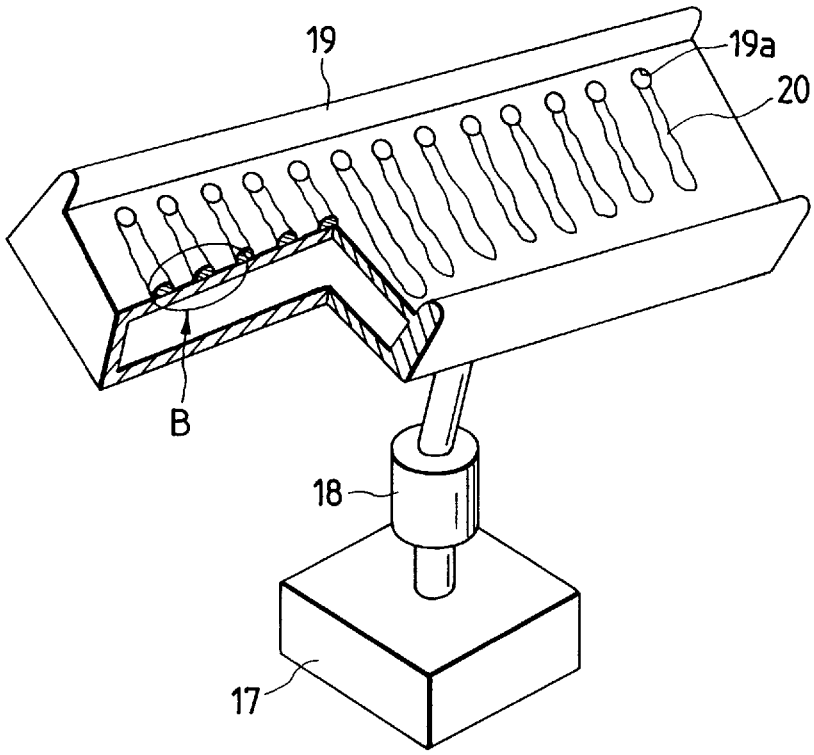
FIG. 7 is a partially sectional perspective view of a conventional release agent supplying member.
Figure 8:
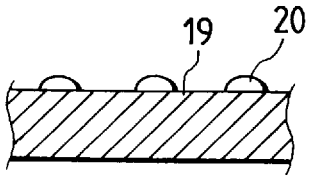
FIG. 8 is an enlarged sectional view of a portion B in FIG. 7.

In FIG. 5, a reference numeral 1 depicts a photosensitive drum which forms a toner image thereon through the electrophotographic process. The photosensitive drum 1 is supported by a supporting axis so that it rotates to the direction shown by an arrow "a" at a constant speed. An electric charger 2 is disposed so as to oppose to the surface of the photosensitive drum 1, thereby to uniformly charge the surface of the photosensitive drum 1 which passes the charger 2 in opposing relation. A laser beam 3, for exposing the surface of the photosensitive drum 1 having been charged uniformly, is modulated by a print information signal supplied from an information processing apparatus thereby to form an electrostatic latent image on the surface of the photosensitive drum 1. A development apparatus 4 is disposed so as to oppose the surface of the photosensitive drum 1 on which the electrostatic latent image is formed. The development apparatus 4 has a developing function of adhering powder toner to the surface of the photosensitive drum 1 by the electrostatic power of the electrostatic latent image thereby to form a toner image.

A sheet hopper 7 receives, in a folded state, a continuous recording material (printing sheet) 6 of belt-like configuration to which the toner image is transferred and fixed to perform image printing thereon. Transfer rollers 8*a,* 8*b* forming a part of a print sheet transfer means take in the print sheet 6 from the hopper 7 and send it to the photosensitive drum 1.

The print sheet 6 sent out from the transfer rollers 8*a,* 8*b* is put in contact with the surface of the photosensitive drum 1 so that the toner image is transferred to the surface of the print sheet from the photosensitive drum 1. A transfer unit 5 applies electric charge, whose polarity is opposite to that of the toner image, to the rear surface of the print sheet 6 put in contact with the photosensitive drum 1, thereby to generate on the rear surface of the print sheet 6 electrostatic force for moving (transferring) the toner image formed on the surface of the photosensitive drum 1 to the surface of the print sheet 6.

Transfer rollers 9*a,* 9*b* forming another part of the print sheet transfer means send the print sheet 6, on which the toner image has been transferred, to a preheater 10. The preheater 10 is disposed at the upstream side of fixing rollers 11 and made in contact with the rear surface of the print sheet 6 holding the toner image thereon, thereby to preheat the print sheet 6.

The preheater 10 is arranged, for example, in a manner that an electric heater is mounted to the rear surface of a heat transfer member with which the rear surface of the print sheet 6 contacts. The preheater 10 heats the print sheet 6 to such a degree that the toner image adhered to the print sheet 6 is softened while the print sheet 6 moves over the surface of the preheater 10 and in contact therewith. The temperature of the preheater 10 can be adjusted by controlling the current supplied to the electric heater by a temperature control device 16.

The pair of fixing rollers 11 formed by a heat roller 11*a* and a pressure roller 11*b,* urged against the heat roller 11*a,* heat and pressurize the print sheet 6 which was preheated by contact with the preheater 10, thereby fixing the toner image on the surface of the print sheet 6. The print sheet 6 sent from the fixing rollers 11 is pulled in by puller rollers 12*a,* 12*b* and then folded and received within a stacker 13 or ejected out of the electrophotographic apparatus.

Figure 1:
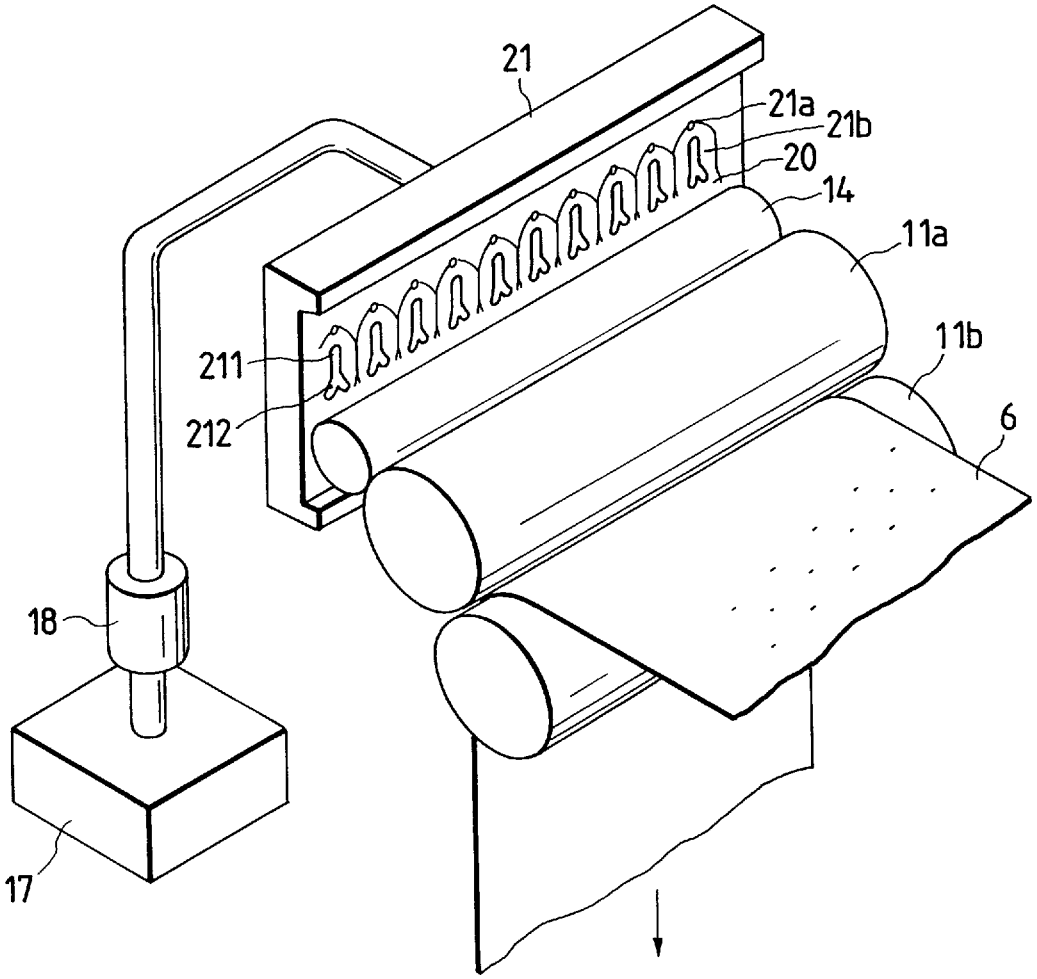
FIG. 1 is a perspective view showing an embodiment of a fixing apparatus according to the present invention.
Figure 2:
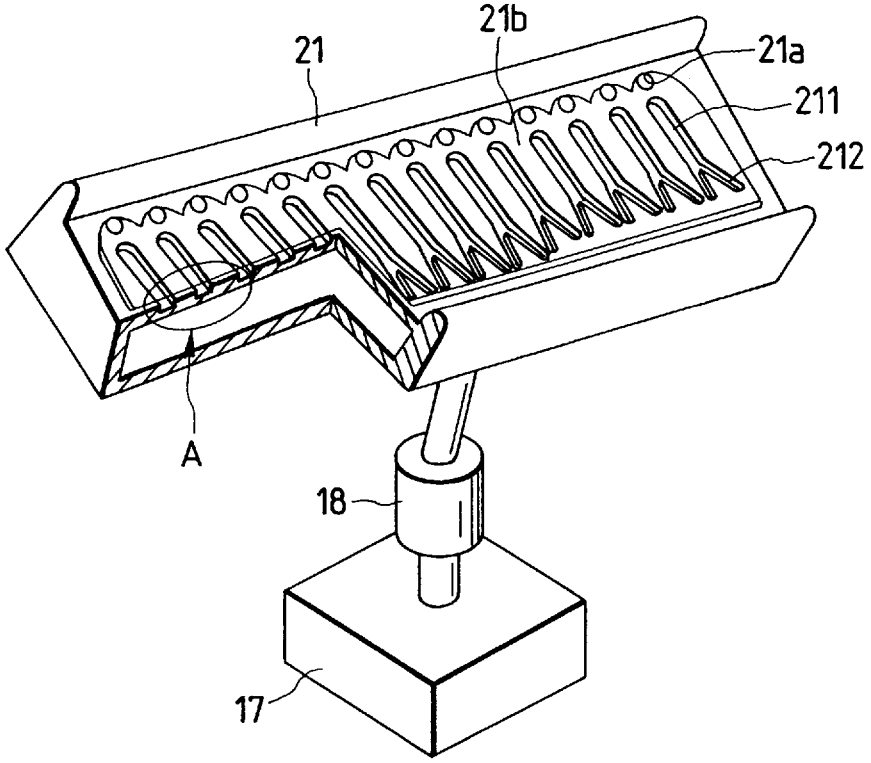
FIG. 2 is a partially sectional perspective view of a release agent supplying member according to the present invention.

The release agent supplying apparatus for supplying the release agent such as silicon oil to the heat roller 11*a* is formed, as shown in FIGS. 1 and 2, by a release agent tank 17 receiving the release agent therein, a pump 18 for drawing the release agent received within the release agent tank 17, and a release agent supplying member 21 having release agent discharge portions 21*a* for discharging the release agent and liquid level uniforming portions 21*b* for uniforming the liquid level of the release agent 20 discharged from the release agent discharge portions 21*a*. A release agent coating roller 14 serving as the subject to be coated with the release agent thereon is provided at the release agent position of the release agent supplying member 21 where the liquid level of the release agent is made uniform.

In the aforesaid configuration, the release agent 20 is drawn from the tank 17 by the pump 18, then discharged from the release agent discharge portions 21*a* provided at the release agent supplying member 21 and flows down on the upper surface of the release agent supplying member 21.

In this case, the release agent 20 passes the liquid level uniforming portions 21*b* provided of beneath of the release agent discharge portions 21*a*. The liquid level uniforming portions 21*b* are formed as a member having such functions of dispersing the release agent in the longitudinal direction of the subject to be coated as the release agent flows down, as well as ensuring flowing paths of the release agent.

Figure 3:
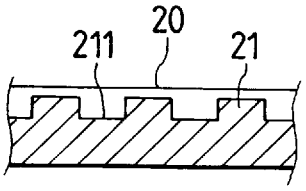
FIG. 3 is an enlarged sectional view of a portion A in FIG. 2.

According to this embodiment, groove portions 211 are formed on the upper surface of the release agent supplying member 21 so as to form level differences thereon thereby to obtain the liquid level uniforming portions 21*b*. The release agent 20 which passes the liquid level uniforming portions 21*b* remains within the groove portions 211 of the liquid level uniforming portions 21*b*. Accordingly, as shown in FIG. 3, the liquid level of the release agent will be uniform even at portions away from the liquid level uniforming portions 21*b,* and hence the release agent uniformly flows down on the upper surface of the release agent supplying member while ensuring the flowing paths thereof.

The release agent coating roller 14 is made to contact the release agent supplying member 21 at a position just beneath the liquid level uniforming portions 21*b,* that is, at a position where the liquid level of the release agent is made uniform. The release agent coating roller is arranged so as to be driven by the heat roller 11*a*.

Branched grooves 212 are formed at the lower portions of the groove portions 211 as shown in FIGS. 1 and 2 in such a configuration that each of the grooves are branched to the moving (flowing) direction of the release agent. Accordingly, the dispersion property of the release agent in the axial direction of the heat roller 11*a* is improved and thus the release agent is supplied and coated more uniformly.

Figure 9:
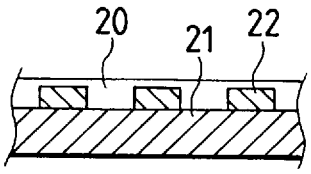
FIG. 9 is a sectional view showing a still another embodiment of the present invention.

While in the aforesaid embodiment the grooves of branched shape shown in the figures have been employed as the liquid level uniforming portions 21*b,* the shape of the grooves of the liquid level uniforming portions is not limited thereto. For example, crossing grooves of "X" shape may be provided along the axial direction of the release agent coating roller 14. It has been proved by experiments that the function and technical effects obtained by using such crossing grooves are the same as those obtained by the grooves of branched shape. Further, in the aforesaid explanation the liquid level uniforming portions 21*b* are formed on the upper surface of the release agent supplying member 21. Alternatively, partition members 22 may be provided on the upper surface of the release agent supplying member 21 to form concave portions thereon thereby to obtain liquid level uniforming portions 21*b,* as shown in FIG. 9.

Figure 4:
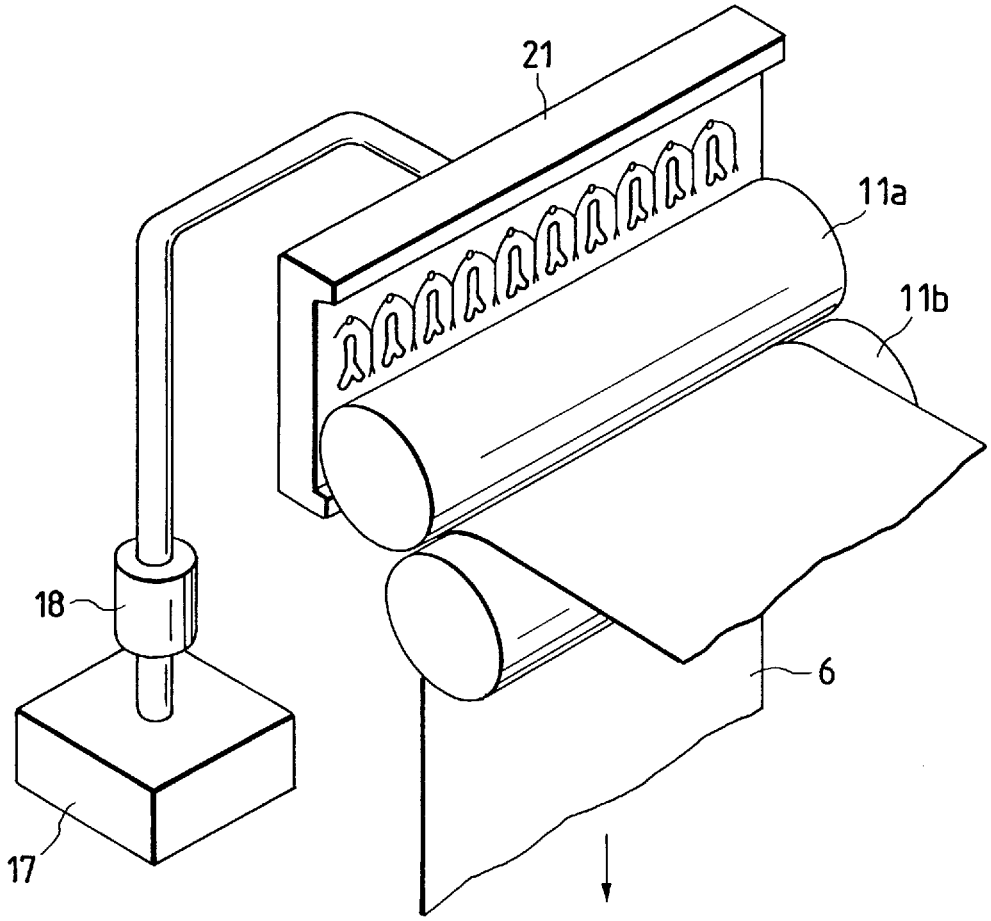
FIG. 4 is a perspective view showing another embodiment of the present invention.

Although, in this embodiment, explanation has been made a case where the subject to be coated is the release agent coating roller, the subject to be coated is not limited to the release agent coating roller. That is, when the release agent coating roller is not provided between the release agent supplying member 21 and the heat roller 11*a* as shown in FIG. 4, the heat roller corresponds to the subject to be coated.

As the occasion demands, the release agent may be applied to the pressure roller as well as the heat roller. In this case, of course, the pressure roller corresponds to the subject to be coated.

As described above, according to the present invention, it is possible to obtain a release agent supplying member and a release agent supplying apparatus each of which is able to supply release agent uniformly to a subject to be coated. Further, it is possible to obtain a fixing apparatus which is able to supply release agent uniformly to a subject to be coated and provide stable printing quality.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A release agent supplying member, comprising:

release agent discharge portions for discharging release agent; and liquid level uniforming portions for making uniform a liquid level of said release agent, discharged from said release agent discharge portions, before supplying said release agent to a subject to be coated, wherein said liquid level uniforming portions have groove portions forming flowing paths for said release agent discharged from said release agent discharge portions.

2. A release agent supplying member according to claim 1, wherein each of said groove portions is branched as said release agent proceeds in its moving direction.

3. A release agent supplying member according to claim 1, further comprising a planar surface on which said release agent discharge portions are located.

4. A release agent supplying member, comprising:

release agent discharge portions for discharging release agent; and groove portions each for dispersing said release agent, discharged from said release agent discharge portions, in a longitudinal direction of a subject to be coated.

5. A release agent supplying member according to claim 4, wherein each of said groove portions is branched as said release agent proceeds in its moving direction.

6. A release agent supplying member according to claim 4, further comprising a planar surface on which said release agent discharge portions are located.

7. A release agent supplying member according to claim 4, wherein said groove portions are separate from one another.

8. A release agent supplying member according to claim 7, wherein said groove portions uniformly disperse said release agent, discharged from said release agent discharge portions, along the entire axial length of the release agent supply member.

9. A release agent supplying apparatus, comprising:

a release agent tank for receiving release agent therein;

a pump for drawing said release agent from said release agent tank;

a release agent supplying member having release agent discharge portions for discharging said release agent drawn from said release agent tank, and liquid level uniforming portions for making uniform a liquid level of said release agent discharged from said release agent discharge portions; and a subject to be coated disposed at a position on said release agent supplying member where a level of said release agent is made uniform.

10. A release agent supplying apparatus according to claim 9, wherein said liquid level uniforming portions of said release agent supplying member have groove portions forming flowing paths for said release agent discharged from said release agent discharge portions.

11. A release agent supplying apparatus according to claim 10, wherein each of said groove portions is branched as said release agent proceeds in its moving direction.

12. A release agent supplying apparatus, comprising:

a release agent tank for receiving release agent therein;

a pump for drawing said release agent from said release agent tank;

a release agent supplying member having release agent discharge portions for discharging said release agent drawn from said release agent tank, and groove portions for uniformly dispersing flowing paths of said release agent discharged from said release agent discharge portions; and a subject to be coated disposed at a position on said release agent supplying member where said release agent is dispersed almost uniformly.

13. A release agent supplying apparatus according to claim 12, wherein each of said groove portions of said release agent supplying member is branched as said release agent proceeds in its moving direction.

14. A release agent supplying apparatus according to claim 12, wherein said groove portions are separate from one another.

15. A release agent supplying member according to claim 14, wherein said groove portions uniformly disperse said release agent, discharged from said release agent discharge portions, along the entire axial length of the release agent supply member.

16. A fixing apparatus comprising:

a heat roller;

a pressure roller provided so as to be able to be urged against said heat roller;

a release agent coating roller in contact with a surface of said heat roller for coating release agent thereon;

a release agent tank for receiving said release agent therein;

a pump for drawing said release agent from said release agent tank;

a release agent supplying member for supplying said release agent drawn from said release agent tank to said release agent coating roller;

wherein recording material is sandwiched and carried by said heat roller and said pressure roller while being heated and pressurized at a pressing portion between said heat roller and said pressure roller to fix a toner image on a surface of said recording material;

wherein said release agent supplying member includes release agent discharge portions for discharging said release agent drawn from said release agent tank, and liquid level uniforming portions for making uniform a liquid level of said release agent discharged from said release agent discharge portions; and wherein said release agent coating roller is disposed at a position on said release agent supplying member where a liquid level of said release agent is made uniform.

17. A fixing apparatus according to claim 16, wherein said liquid level uniforming portions of said release agent supplying member have groove portions forming flowing paths for said release agent discharged from said release agent discharge portions.

18. A release agent supplying apparatus according to claim 17, wherein each of said groove portions is branched as said release agent proceeds in its moving direction.

19. A fixing apparatus comprising:

a heat roller;

a pressure roller provided so as to be able to be urged against said heat roller;

a release agent coating roller in contact with a surface of said heat roller for coating release agent thereon;

a release agent tank for receiving said release agent therein;

a pump for drawing said release agent from said release agent tank; and a release agent supplying member for supplying said release agent drawn from said release agent tank to said release agent coating roller;

wherein recording material is sandwiched and carried by said heat roller and said pressure roller while being heated and pressurized at a pressing portion between said heat roller and said pressure roller thereby to fix a toner image on a surface of said recording material;

wherein said release agent supplying member includes release agent discharge portions for discharging said release agent drawn from said release agent tank, and groove portions for dispersing flowing paths of said release agent discharged from said release agent discharge portions; and wherein said release agent coating roller is disposed at a position on said release agent supplying member where said release agent is dispersed almost uniformly.

20. A fixing apparatus according to claim 19, wherein each of said groove portions of said release agent supplying member is branched as said release agent proceeds in its moving direction.

* * * * *